US008141535B2

(12) United States Patent
Olsen et al.

(10) Patent No.: US 8,141,535 B2
(45) Date of Patent: Mar. 27, 2012

(54) EXHAUST SYSTEM DEVICE WITH MOUNTING BRACKET

(75) Inventors: Paul Frederick Olsen, Chillicothe, IL (US); Jack Albert Merchant, Peoria, IL (US); Eric James Charles, Peoria, IL (US); Muthukumar Chandrasekaran Trichirapalli, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 673 days.

(21) Appl. No.: 12/320,427

(22) Filed: Jan. 26, 2009

(65) Prior Publication Data

US 2010/0187383 A1 Jul. 29, 2010

(51) Int. Cl.
*F02B 67/00* (2006.01)
*F02B 77/04* (2006.01)

(52) U.S. Cl. ..... 123/198 E; 123/195 A; 55/282.1; 248/201

(58) Field of Classification Search ..... 123/198 R, 123/198 E, 195 A; 55/385.3, 282.1; 248/282.1, 248/385.3

See application file for complete search history.

(56) References Cited

U.S. PATENT DOCUMENTS

| | | | |
|---|---|---|---|
| 3,307,336 | A | 3/1967 | Dewsberry |
| 4,011,849 | A | 3/1977 | Latham |
| 4,133,547 | A | 1/1979 | Fox |
| 4,338,890 | A | 7/1982 | Shelby et al. |
| 4,371,047 | A | 2/1983 | Hale et al. |
| 4,454,926 | A | 6/1984 | Akins |
| 4,503,931 | A | 3/1985 | Sugimoto et al. |
| 6,223,845 | B1 | 5/2001 | Miyachi et al. |
| 2005/0217625 | A1 | 10/2005 | Niaken et al. |

*Primary Examiner* — Noah Kamen
(74) *Attorney, Agent, or Firm* — Finnegan, Henderson, Farabow, Garrett & Dunner LLP

(57) ABSTRACT

An exhaust system device is disclosed. The exhaust system device may have a mount supporting a first exhaust treatment device and a second exhaust treatment device. The exhaust system device may also have a mounting bracket coupled to the mount. The exhaust system device may further have an air cleaner attached to the mounting bracket. The mounting bracket may be configured to substantially occlude the air cleaner from thermal radiation emitted by the first exhaust treatment device and the second exhaust treatment device.

20 Claims, 5 Drawing Sheets

EXHAUST SYSTEM DEVICE WITH MOUNTING BRACKET

TECHNICAL FIELD

The present disclosure relates generally to a bracket for mounting an air cleaner and, more particularly, to a bracket configured to mount an air cleaner in an exhaust system.

BACKGROUND

Conventional diesel powered systems for engines, factories, and power plants produce emissions that contain a variety of pollutants. These pollutants may include, for example, particulate matter (e.g., soot), nitrogen oxides (NOx), and sulfur compounds. Due to heightened environmental concerns, engine exhaust emission standards have become increasingly stringent. In order to comply with emission standards, machine manufacturers have developed and implemented a variety of exhaust treatment devices to reduce pollutants in exhaust gas prior to the exhaust gas being released into the atmosphere. The exhaust treatment devices may include, for example, a diesel particulate filter, a selective catalytic reduction device, a diesel oxidation catalyst, a fuel-fired burner for regeneration of the diesel particulate filter, a muffler, and other similar devices.

Frequently these exhaust treatment devices are mounted individually in an exhaust system within the available space using individual brackets. However, due to the increasing complexity and number of exhaust treatment devices and the small amount of available space, mounting and interconnecting exhaust treatment devices has proven difficult.

In some circumstances, it may also be desirable to mount non-exhaust treatment devices in the exhaust treatment system. However, the high temperatures created by the exhaust treatment system may damage or diminish performance of the non-exhaust treatment devices, their related systems, or both.

U.S. Pat. No. 4,011,849 (the '849 patent) to Latham discloses a combined engine and muffler compartment. The '849 patent discloses a heat shield assembly to intercept and reflect heat radiated from the muffler. Specifically, the heat shield assembly includes a lower shield section generally in the form of a box having an open top, a reservoir, and side panels. The shield section of the '849 patent is supported from the engine through means including a pair of transversely spaced brackets respectively connected between a pair of mounting blocks fixed to the end walls and a pair of air cleanser support bands, which grip the periphery of an air cleaner and are respectively secured to the engine by a pair of mounts.

Although the system of the '849 patent may disclose a combined engine and muffler compartment with a shield section, the '849 system may only protect the air cleaner from the muffler and not other exhaust system components. Furthermore, the '849 system may not provide an integrated, compact, and cost-effective mounting solution.

The disclosed cooling device is directed to overcoming one or more of the problems set forth above.

SUMMARY OF THE DISCLOSURE

In one aspect, the present disclosure is directed to an exhaust system device. The exhaust system device may include a mount supporting a first exhaust treatment device and a second exhaust treatment device. The exhaust system device may also include a mounting bracket coupled to the mount. The exhaust system device may further include an air cleaner attached to the mounting bracket. The mounting bracket may be configured to substantially occlude the air cleaner from thermal radiation emitted from the first exhaust treatment device and the second exhaust treatment device.

In another aspect, the present disclosure is directed to another exhaust system device. The exhaust system device may include a mount. The mount may include a first bracket, and a second bracket coupled to the first bracket. The exhaust system device may also include a first exhaust treatment device supported by the first bracket and the second bracket, and a second exhaust treatment device supported by the first bracket and the second bracket. The exhaust system device may further include a mounting bracket coupled to the mount. The exhaust system device may also include an air cleaner coupled to the mounting bracket. A width of the mounting bracket may be greater than a width of the air cleaner and a height of the mounting bracket may be greater than a height of the air cleaner such that the mounting bracket may be entirely interposed between the air cleaner and the first and second exhaust treatment devices.

DETAILED DESCRIPTION

Figure 1:
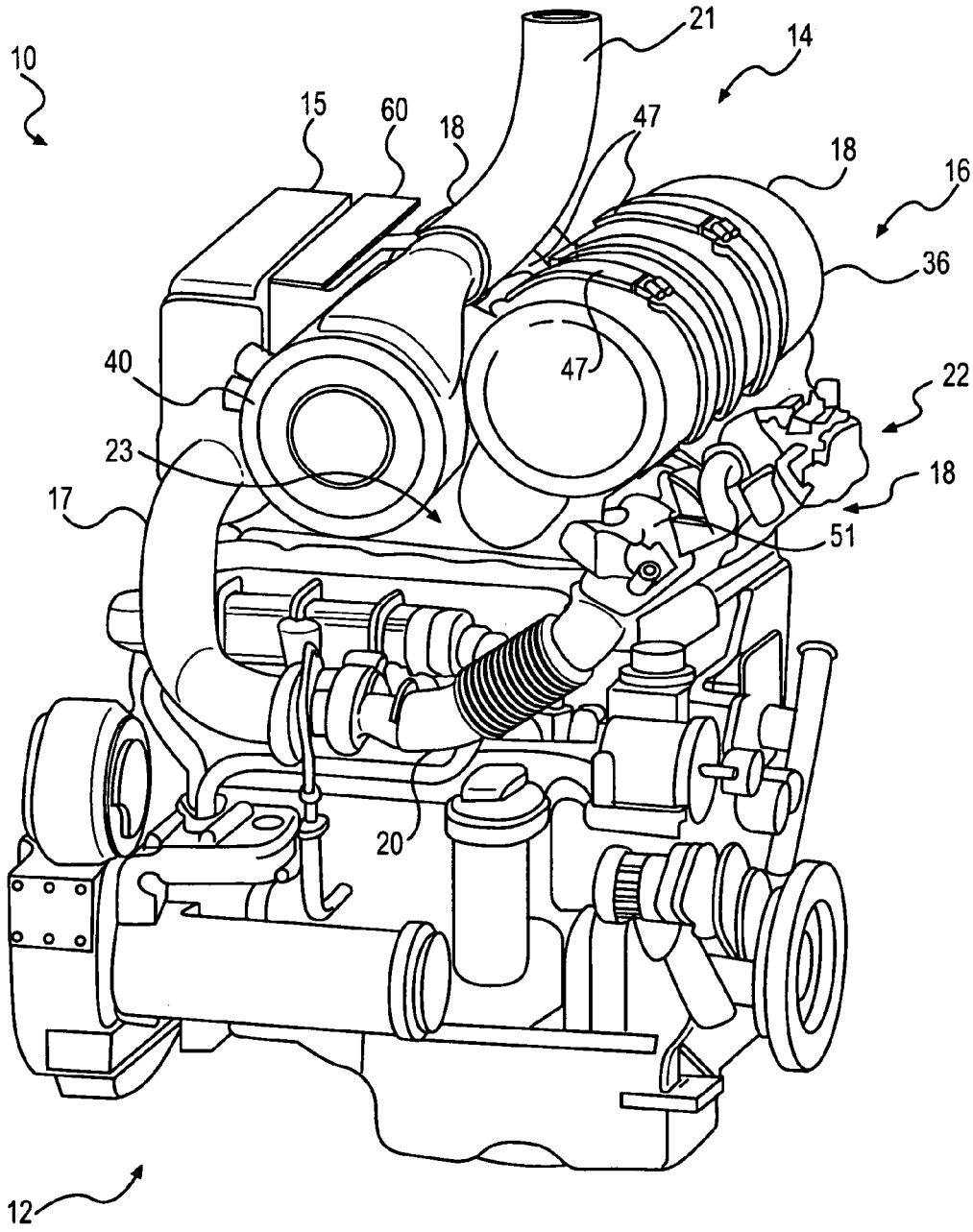
FIG. 1 is a diagrammatic illustration of an exemplary disclosed power system including an emissions control system.

FIG. 1 illustrates a diagrammatic representation of a power system 10, which may include a power source 12 and an exhaust system 14. Power source 12 may embody a combustion engine, such as, for example, a diesel engine, a gasoline engine, a gaseous fuel-powered engine (e.g., a natural gas engine), or any other type of combustion engine known to one skilled in the art. Power source 12 may have a plurality of combustion chambers (not shown) that convert potential chemical energy (usually in the form of a combustible gas) into useful mechanical work. It is also considered that power source 12 may embody a furnace or a similar device. Power source 12 may receive air from an air cleaner 15 which fluidly communicates with power source 12 via intake 17.

Air cleaner 15 may be a device used to prevent particulates and other impurities in the air from entering power source 12. Air cleaner 15 may have filtering elements (not shown) composed of paper, foam, cotton, and/or other natural or synthetic fibers. As air passes through the filtering elements in air cleaner 15, the filtering elements may trap or attract the particulates and other impurities, thus helping remove them from the air prior to the air entering power source 12.

Exhaust system 14 may direct exhaust from power source 12 via an exhaust passageway 20 and through an emissions control system 16. After passing through emissions control system 16, the exhaust may be directed to the atmosphere via an exhaust stack 21. Emissions control system 16 of exhaust system 14 may be configured to monitor, control, and/or modify exhaust emissions. Emissions control system 16 may include one or more exhaust treatment devices 18, electronics 22 associated with exhaust treatment devices 18, and a mount 23.

Exhaust treatment devices 18 may be devices configured to reduce emissions of harmful gasses, particulate matter, and/or noise emitted from power source 12. Each exhaust treatment device 18 may embody, for example, a diesel oxidation catalyst (DOC), a particulate filter (PF or DPF), a selective catalytic reduction (SCR) device, a lean NOx trap (LNT), a muffler, a regeneration device, a reductant mixing device, or any other exhaust treatment device known in the art. It is contemplated that each exhaust treatment device 18 may also comprise a combination of exhaust treatment devices, such as, for example, a combination of a DOC and a DPF; a combination of a catalyst and a DPF (i.e., a CDPF); a combination of a DOC, a DPF, and an SCR; or other combinations known in the art.

Electronics 22 (also see FIG. 4) may be configured to monitor and/or control operation of exhaust treatment devices 18. Electronics 22 may include one or more electronic devices, such as, for example, sensors, microprocessors, power supply circuitry, signal conditioning circuitry, actuator driving circuitry, solenoids, relays, electronic valves, coils, and/or other types of electronics and circuitry known in the art. For example, electronics 22 may include a microprocessor and other electronic hardware configured to control injection of a reductant into one of exhaust treatment devices 18 (e.g., reductant for SCR or LNT). Electronics 22 may also include a microprocessor and other electronic hardware configured to control a regeneration process for one of exhaust treatment devices 18 (e.g., regeneration of DPF).

Figure 2:
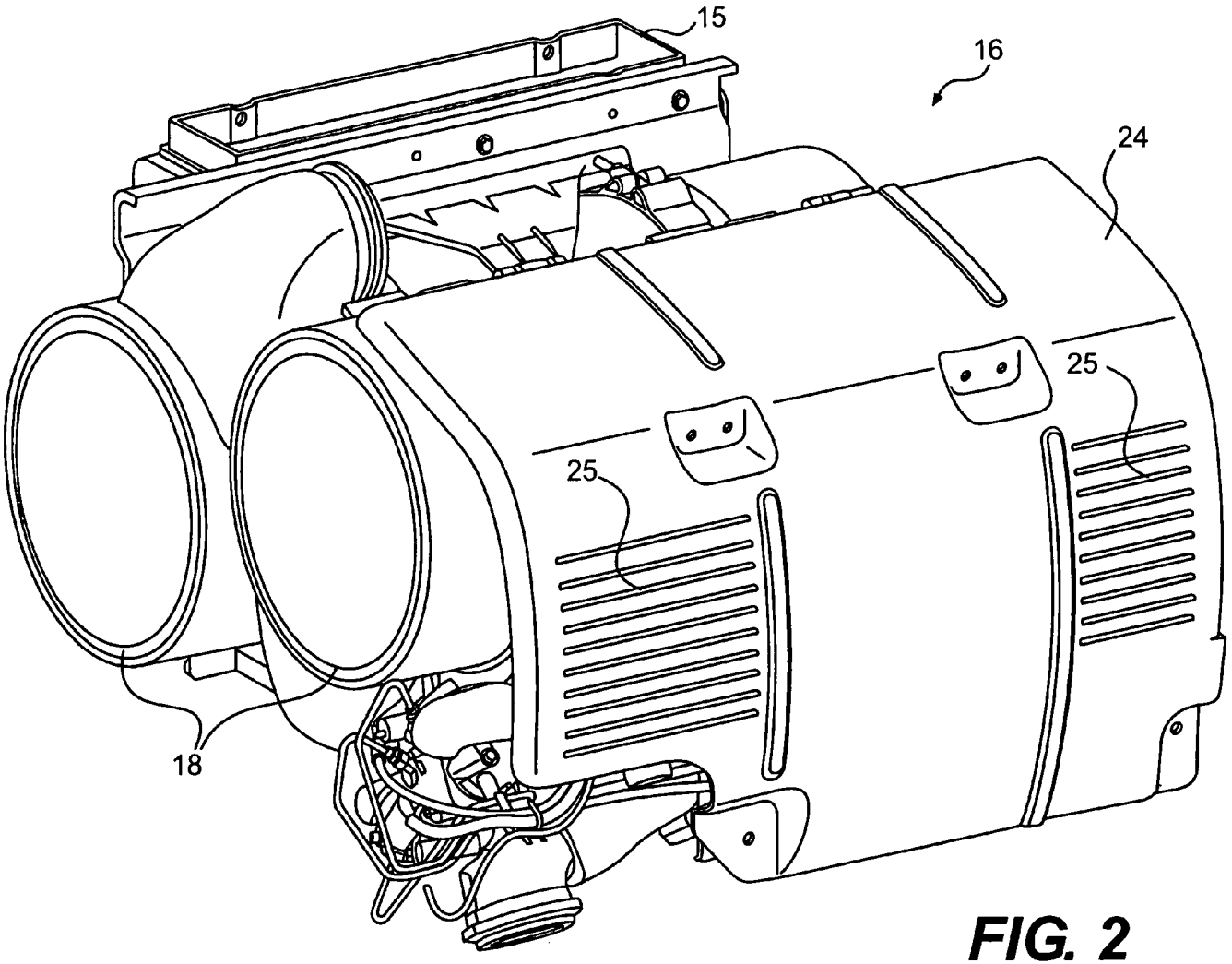
FIG. 2 is a diagrammatic illustration of an exemplary emissions control system.

As shown in FIG. 2, electronics 22 may be covered by a cover 24. Cover 24 may help protect electronics 22 from debris and other objects. In one embodiment, cover 24 may have a substantially L-shaped cross-section. Cover 24 may be composed of plastic, metal, composite, or any other appropriate material. Cover 24 may include a plurality of vents 25 to allow an air flow to reach electronics 22. Vents 25 may help prevent electronics 22 from reaching temperatures that may damage electronics 22.

Figure 3:
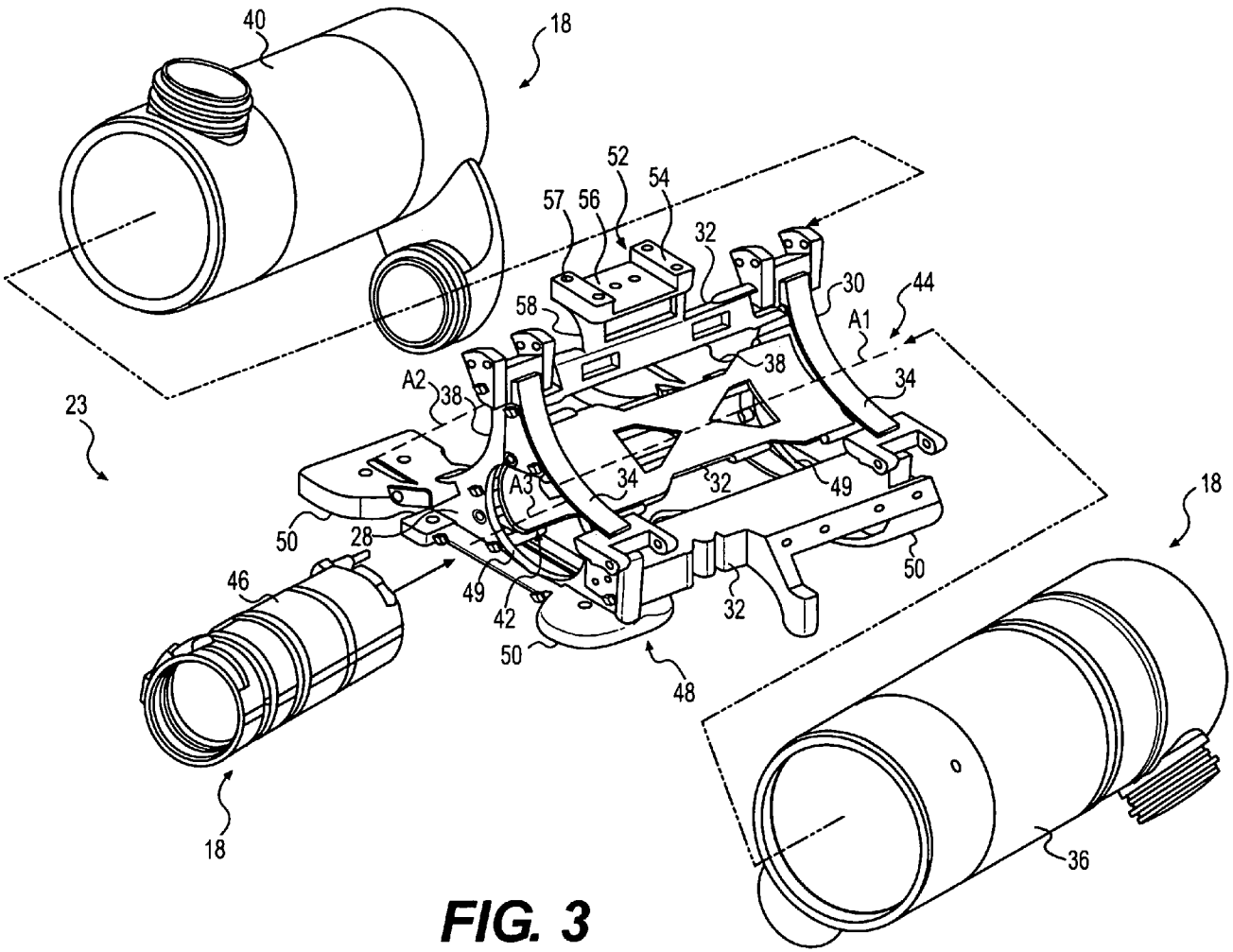
FIG. 3 is an exploded view of an exemplary emissions control system.

As shown in FIG. 3, mount 23 may be a device configured to support multiple exhaust treatment devices 18 using a single structure. Specifically, mount 23 may be configured to secure exhaust treatment devices 18 in a compact configuration. Mount 23 may include a first bracket 28 and a second bracket 30. First bracket 28 and second bracket 30 may be oriented parallel but spaced apart from each other. First bracket 28 may be coupled to second bracket 30 using one or more rigid cross members 32. Cross members 32 may attach to first and second brackets 28 and 30 via mechanical fasteners (e.g., bolts, screws, rivets, etc.), welding, brazing, or any other joining process known in the art. Alternatively, first bracket 28, second bracket 30, and cross members 32 may be formed using a single casting. Mount 23 may be composed of steel, aluminum, iron, alloys, composites, or other appropriate materials known in the art.

Each of first and second brackets 28 and 30 may include a first support surface 34. First support surface 34 of first bracket 28 and first support surface 34 of second bracket 30 may be configured to support each end of a first exhaust treatment device 36. Each of first and second brackets 28 and 30 may also include a second support surface 38. Second support surface 38 of first bracket 28 and second support surface 38 of second bracket 30 may be configured to support each end of a second exhaust treatment device 40. In addition to connecting first and second brackets 28 and 30, one or more of cross members 32 may be configured to support a middle portion of first exhaust treatment device 36 and/or second exhaust treatment device 40.

It is contemplated that a geometry of first support surface 34 may be shaped to match an outer geometry of first exhaust treatment device 36 and a geometry of second support surface 38 may be shaped to match an outer geometry of second exhaust treatment device 40. For example, when first and second exhaust treatment devices 36 and 40 are shaped as canisters, first and second support surfaces 34 and 38 may have generally arcuate surfaces with substantially the same radii of curvature as first and second exhaust treatment devices 36 and 40, respectively. One or more bands 47 (see FIG. 1) may pass over exhaust treatment devices 18 and secure exhaust treatment devices 18 to mount 23.

Mount 23 may also include a first aperture 42 in first bracket 28 and a second aperture 44 in second bracket 30. Each of first and second apertures 42 and 44 may include a third support surface 49. Third support surface 49 of first aperture 42 and third support surface 49 of second aperture 44 may be configured to support, for example, each end of a third exhaust treatment device 46. In an exemplary embodiment of emissions control system 16, first exhaust treatment device 36 may embody a diesel particulate filter, second exhaust treatment device 40 may embody a muffler, and third exhaust treatment device 46 may embody a tube for injection and mixing of reductant.

Mount 26 may also support or house a fourth exhaust treatment device 51 (see FIG. 1). Fourth exhaust treatment device 51 may embody, for example, a regeneration device, such as a fuel fired burner. Fourth exhaust treatment device 51 may be configured to inject fuel and ignite the injected fuel in order to heat the exhaust flow received from power source 12 via exhaust passageway 20.

Returning to FIG. 2, it should be noted that first support surfaces 34, second support surfaces 38, and third support surfaces 49 may be located to allow for first, second, and third exhaust treatment devices, 36, 40, and 46, respectively, to be positioned in a compact, side-by-side, parallel orientation. For example, an axis A1 of first support surfaces 34, an axis A2 of second support surfaces 38, and an axis A3 of third support surfaces 49 may all be parallel. It is contemplated that mount 23 may be configured to allow for easy access and removal of each exhaust treatment device 18.

Mount 23 may include a base portion 48 with one or more footings 50. Specifically, each of first and second brackets 28 and 30 may include, for example, at least two footings 50. Each footing 50 may be configured to mount to power source 12 or another frame or structure (not shown) within power system 10.

Mount 23 may include a stack mount 52. Stack mount 52 may embody a rigid extension to which exhaust stack 21, exhaust conduit (not shown), or other power system device may mount or connect. Stack mount 52 may be attached to or formed integrally with one of cross members 32. Stack mount 52 may be attached to a cross member 32 located substantially between first exhaust treatment device 36 and second exhaust treatment device 40. Stack mount 52 may include an upper mounting surface 54 and a lower mounting surface 56. Lower mounting surface 56 may be recessed within a central portion of upper mounting surface 54. Both upper and lower mounting surface 54 and 56 may be substantially planar surfaces with a plurality of mounting holes 57. Stack mount 52 may also include a radius 58 configured to conform to the outer geometry of second exhaust treatment device 40.

Figure 4:
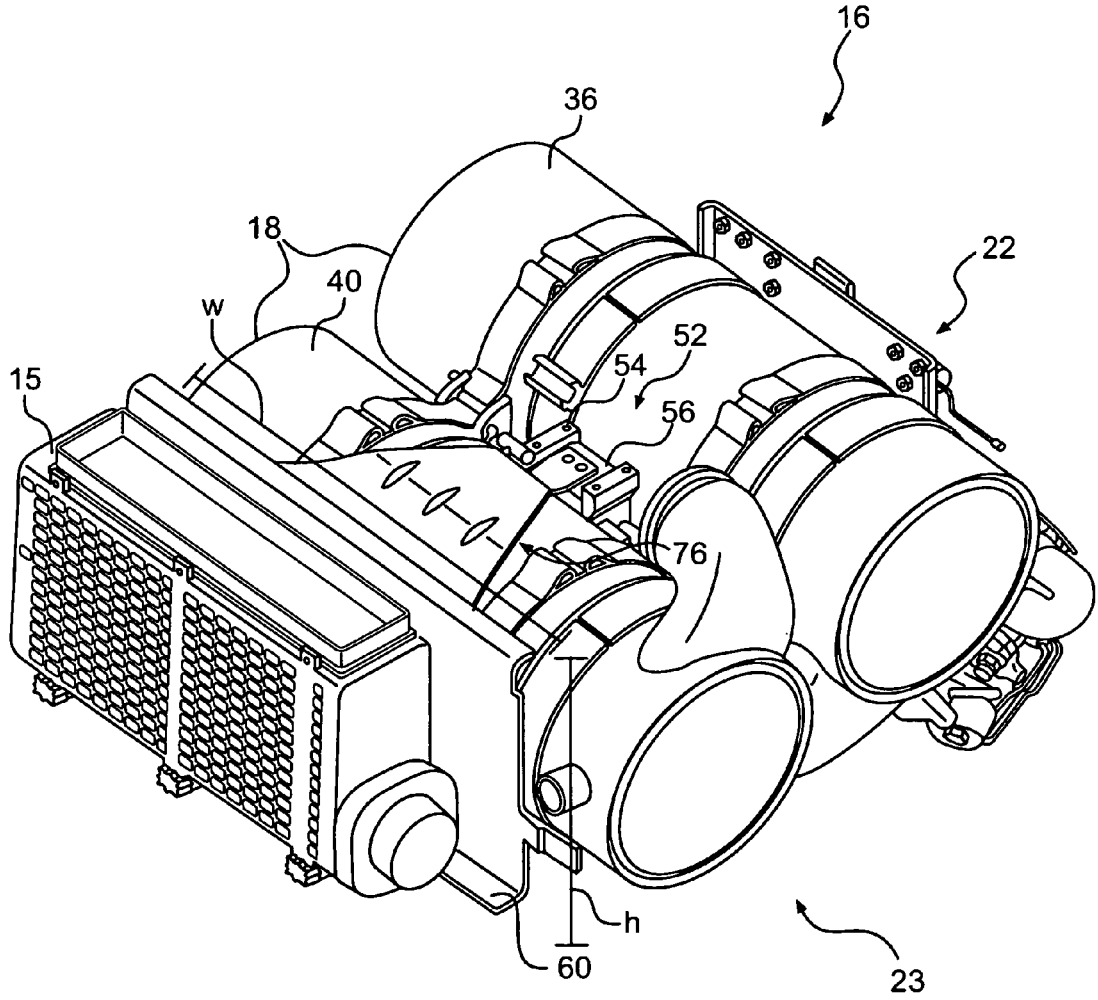
FIG. 4 is another diagrammatic illustration of an exemplary emissions control system.

As shown in FIG. 4, a mounting bracket 60 may connect air cleaner 15 to mount 23. In one embodiment, mounting bracket 60 may be mounted proximal second exhaust treatment device 40. Mounting bracket 60 may embody, for example, a substantially flat plate. Mounting bracket 60 may be shaped and positioned to substantially occlude air cleaner 15 from thermal radiation emitted from exhaust treatment devices 18. For example, mounting bracket 60 may have a width, w, and height, h, that are larger than a corresponding width and height of air clearer 15, respectively. Additionally, mounting bracket 60 may be entirely interposed between air cleaner 15 and exhaust treatment devices 18 (e.g., first exhaust treatment device 36 and the second exhaust treatment device 40), thus shielding air cleaner 15 from thermal radiation emitted from exhaust treatment devices 18. Mounting bracket 60 may be composed of a material and have a thickness that cause mounting bracket 60 to have low or substantially zero transmissivity. Mounting bracket 60 may be composed of, for example, steel, iron, aluminum, carbon fiber, or other materials known in the art. Specifically, mounting bracket 60 may be composed of sheet steel.

It is contemplated that mounting bracket 60 may have a reflective outer surface. For example, the outer surface of mounting bracket 60 may be highly polished. Alternatively, mounting bracket 60 may include a layer of reflective material. The reflective outer surface of mounting bracket 60 may help prevent mounting bracket 60 from absorbing radiated heat (i.e., may reflect substantially all incident radiation).

Figure 5:
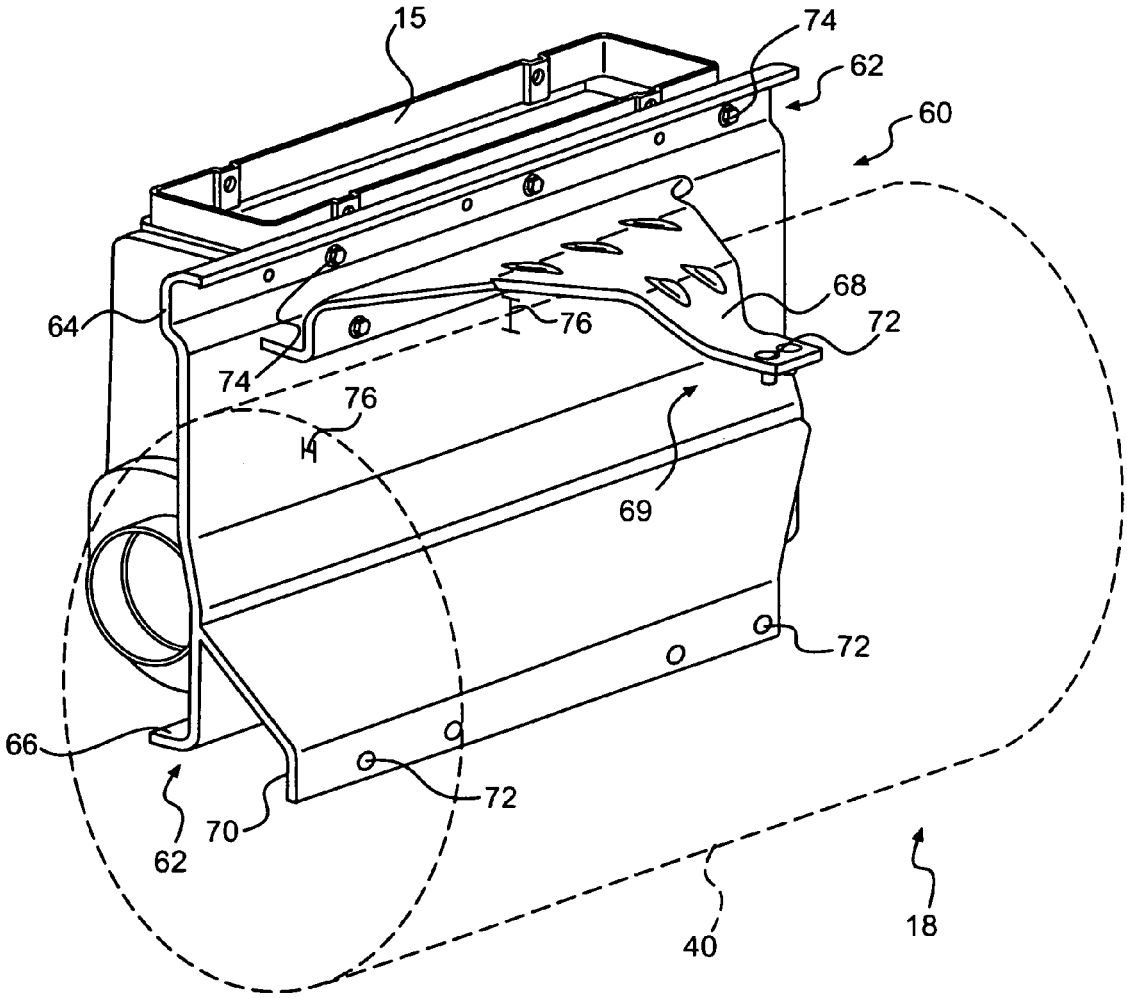
FIG. 5 is a diagrammatic illustration of an exemplary air cleaner and bracket that may be used with the emissions control system of FIGS. 1-4.

As shown in FIG. 5, mounting bracket 60 may include one or more a stiffening bends 62. Stiffening bends 62 may improve the rigidity of mounting bracket 60. Stiffening bends 62 may be located anywhere along the height dimension of mounting bracket 60. In one embodiment, a first stiffening bend 64 may be located at an upper portion of mounting bracket 60 and a second stiffening bend 66 may be located at a lower portion of mounting bracket 60. Stiffening bends 62 may comprise ridges, ribs, flanges, or other types of stiffening bends known in the art.

Mounting bracket 60 may also include a first brace 68 and a second brace 70. First brace 68 may protrude in a substantially tangential direction from the upper portion of mounting bracket 60. First brace 68 may have a slightly curved profile and may pass over the top of second exhaust treatment device 40 and couple to stack mount 52 (also see FIG. 4). A terminal end 69 of first brace 68 may be shaped and configured to mount to lower mounting surface 56. In one embodiment, first brace 68 may taper down from a base of first brace 68 to terminal end 69. Second brace 70 may be located on a lower portion of mounting bracket 60 and may couple to base portion 48, first bracket 28, and/or second bracket 30. First and second braces 68 and 70 may include a plurality of mounting holes 72 that allow mounting bracket 60 to be mounted to mount 23 via mechanical fasteners (e.g., bolts, rivets, screws, etc.). Mounting bracket 60 may alternatively or additionally attach to mount 23 via welding, brazing, or any other joining process known in the art. Mounting bracket 60 may also include a plurality of air cleaner mounting holes 74, which allow air cleaner 15 to mount to mounting bracket 60 (via bolts, rivets, screws, etc.).

It is contemplated that an air gap 76 may be exist between mounting bracket 60 and exhaust treatment devices 18. Specifically, there may be no direct surface contact between first and second braces 68 and 70 and second exhaust treatment device 40. First and second braces 68 and 70 may have direct surface contact only with mount 23. Air gap 76 may help prevent thermal energy from conducting from exhaust treatment devices 18 directly into mounting bracket 60 and air cleaner 15. In some embodiments, mounting bracket 60 may be composed of a thermally resistive material. Alternatively or additionally, thermally resistive materials may be placed in series between mounting bracket 60 and mount 23.

INDUSTRIAL APPLICABILITY

The disclosed bracket may be applicable to any power system. The disclosed bracket may protect an air cleaner from thermal radiation as well as provide a compact structure for mounting the air cleaner in an exhaust system. An exemplary operation of the power system 1 0 using the disclosed bracket will now be described.

Referring back to FIG. 1, air may be drawn into power source 12 for combustion via air cleaner 15 and intake 17. Fuel and air may be combusted to produce a mechanical work output and an exhaust flow. The exhaust flow may contain a complex mixture of air pollutants composed of gases and particulate matter. The exhaust flow may be directed from power source 12 via exhaust passageway 20 to exhaust treatment devices 18. The flow of exhaust may pass through first exhaust treatment device 36 and then through third exhaust treatment device 46 (see FIG. 3). The flow of exhaust may then be communicated to second exhaust treatment device 40. After passing through exhaust treatment devices 18, the exhaust flow may be released into the atmosphere via exhaust stack 21.

Heat from the flow of exhaust or other sources (e.g., regeneration) may transfer to exhaust treatment devices 18 causing exhaust treatment devices 18 to emit thermal radiation. The thermal radiation emitted toward air cleaner 15 may be blocked or reflected by mounting bracket 60.

The disclosed bracket and mount may be applicable to any exhaust system. For example, the disclosed bracket may help prevent the air cleaner from experiencing high temperatures. High air cleaner temperatures may result in high air intake temperatures and decreased power source performance. Thus, preventing high air cleaner temperatures may help improve the overall performance of the power system. The disclosed bracket and mount may also provide a compact structure for mounting exhaust treatment devices and an air bracket in the exhaust system, thus preserving space for other power system components.

It will be apparent to those skilled in the art that various modifications and variations can be made to the disclosed bracket and mount. Other embodiments will be apparent to those skilled in the art from consideration of the specification and practice of the disclosed bracket and mount. It is intended that the specification and examples be considered as exemplary only, with a true scope being indicated by the following claims.

What is claimed is:

1. An exhaust system device, comprising:

a mount supporting a first exhaust treatment device and a second exhaust treatment device;

a mounting bracket coupled to the mount; and an air cleaner attached to the mounting bracket, the mounting bracket being configured to substantially occlude the air cleaner from thermal radiation emitted from the first exhaust treatment device and the second exhaust treatment device.

2. The device of claim 1, wherein the mounting bracket further includes a first brace and a second brace, wherein the first brace and the second brace couple the mounting bracket to the mount.

3. The device of claim 2, wherein the mount further includes:

a first bracket;

a second bracket; and a cross member coupling the first bracket to the second bracket.

4. The device of claim 3, wherein the mount further includes a stack mount attached to the cross member, the stack mount including an upper mounting surface and a lower mounting surface.

5. The device of claim 4, wherein the first brace passes over the second exhaust treatment device and couples to the stack mount.

6. The device of claim 5, wherein an air gap exists between the mounting bracket and the second exhaust treatment device such that the mounting bracket and the second exhaust treatment device have no direct contact.

7. The device of claim 5, wherein an outer surface of the mounting bracket is configured to reflect substantially all incident radiation.

8. The device of claim 1, wherein the mounting bracket includes at least one stiffening bend.

9. The device of claim 1, wherein the mount further includes a first aperture in the first bracket and a second aperture in the second bracket, the first aperture and the second aperture being configured to support a third exhaust treatment device, wherein the first exhaust treatment device, the second exhaust treatment device, and the third exhaust treatment device are positioned in a parallel, side-by-side orientation.

10. The device of claim 9, wherein the first exhaust treatment device, the second exhaust treatment device, and the third exhaust treatment device each embody at least one of a diesel oxidation catalyst, a particulate filter, a selective catalytic reduction device, a lean NOx trap, a muffler, a regeneration device, or a reductant mixing device.

11. The device of claim 10, wherein the first exhaust treatment device, the second exhaust treatment device, and the third exhaust treatment device each embody at least one of a diesel oxidation catalyst, a particulate filter, a selective catalytic reduction device, a lean NOx trap, a muffler, a regeneration device, or a reductant mixing device.

12. The device of claim 1, wherein the mount further includes a first aperture in the first bracket and a second aperture in the second bracket, the first aperture and the second aperture being configured to support a third exhaust treatment device, wherein the first exhaust treatment device, the second exhaust treatment device, and the third exhaust treatment device are positioned in a parallel, side-by-side orientation.

13. An exhaust system device, comprising:

a mount including:

a first bracket; and a second bracket coupled to the first bracket;

a first exhaust treatment device supported by the first bracket and the second bracket;

a second exhaust treatment device supported by the first bracket and the second bracket;

a mounting bracket coupled to the mount; and an air cleaner coupled to the mounting bracket, a width of the mounting bracket being greater than a width of the air cleaner and a height of the mounting bracket being greater than a height of the air cleaner such that the mounting bracket is entirely interposed between the air cleaner and the first and second exhaust treatment devices.

14. The device of claim 13, wherein the mounting bracket has substantially zero transmissivity.

15. The device of claim 13, wherein the mounting bracket further includes a first brace and a second brace, wherein the first brace and the second brace couple the mounting bracket to the mount.

16. The device of claim 15, wherein the mount further includes:

a cross member coupling the first bracket to the second bracket; and a stack mount attached to the cross member, the stack mount including an upper mounting surface and a lower mounting surface.

17. The device of claim 16, wherein the first brace passes over the second exhaust treatment device and couples to the stack mount.

18. The device of claim 17, wherein an air gap exists between the mounting bracket and the second exhaust treatment device such that the mounting bracket and the second exhaust treatment device have no direct contact.

19. The device of claim 13, wherein an outer surface of the mounting bracket is configured to reflect substantially all incident radiation.

20. A device for a power system, comprising:

a first bracket;

a second bracket coupled to the first bracket;

a first support surface in each of the first bracket and the second bracket, the first support surface being configured to support a first exhaust treatment device;

a second support surface in each of the first bracket and the second bracket, the second support surface being configured to support a second exhaust treatment device a mounting bracket coupled to the first bracket and the second bracket; and an air cleaner mounted to the mounting bracket, the mounting bracket occluding the air cleaner from thermal radiation emitted by the first exhaust treatment device and the second exhaust treatment device.

* * * * *